US005245719A

United States Patent [19]

Ott

[11] Patent Number: 5,245,719

[45] Date of Patent: Sep. 21, 1993

[54] INFLATABLE SUPPORT FOR A HUMAN TORSO

[76] Inventor: Rolf Ott, Neue Jonastrasse 24, 8640 Rapperswill, Switzerland

[21] Appl. No.: 922,192

[22] Filed: Jul. 30, 1992

[51] Int. Cl.[5] ..... A47C 27/10; A47C 27/08

[52] U.S. Cl. ..... 5/632; 5/630; 5/455

[58] Field of Search ..... 5/644, 449, 455, 630, 5/632; 441/66, 129

[56] References Cited

U.S. PATENT DOCUMENTS

| | | | |
|---|---|---|---|
| 2,765,480 | 10/1956 | Mueller | 5/644 |
| 2,816,299 | 12/1957 | Holladay | 5/457 |
| 2,952,856 | 9/1960 | Ruff | 5/644 |
| 3,056,979 | 10/1962 | Holladay | 441/66 |
| 4,255,824 | 3/1981 | Pertchik | 5/644 |
| 5,097,553 | 3/1992 | Boland | 5/648 |

*Primary Examiner*—Alexander Grosz

*Attorney, Agent, or Firm*—Abelman Frayne & Schwab

[57] ABSTRACT

An inflatable support for a human torso is provided which has the general form of a catamaran, and which provides a tunnel extending longitudinally of the support within which additional supporting members can be confined, whereby to provide for adjustability of the support in dependence on the requirements of the user.

8 Claims, 3 Drawing Sheets

INFLATABLE SUPPORT FOR A HUMAN TORSO

FIELD OF THE INVENTION

This invention relates to a support for a human torso, the support providing for adjustability of the supporting characteristics of specific areas of the support in order to meet the particular requirements of the user. Adjustment of the supporting characteristics of the support can be effected either by the user, or, by a physician, therapist, masseur, in order to provide therapeutic benefit to the user.

BACKGROUND OF THE INVENTION

Inflatable mattresses are well-known in the art, those mattresses commonly being provided by two or more sheets of plastics material, such as vinyl, that have been sealed to each other in a predetermined pattern in order to provide a plurality of inflatable sealed compartments. Typically, such mattresses are comprised of a plurality of tubular, substantially cylindrical compartments interconnected one with the next adjacent compartment, and which are arranged parallel to each other in side-by-side relation.

While such inflatable mattresses are admirable for their intended use, which typically is that of a mattress that is to be employed on a temporary basis, they are not necessarily comfortable for the user, and, they are not readily adjustable in order to produce maximum comfort to the user, such as is required in the event that the user has a physical disability or, is undergoing post-surgical recovery, or, is employing the mattress for relaxation by the user.

OBJECT OF THE INVENTION

The object of this invention is to provide an inflatable support that has the capability of supporting a human torso in a manner militating against rolling of the user's body laterally of the support, and which can selectively be provided with selected reinforcements in determined areas of the mattress in order to provide maximum comfort to the user of the support.

This can be of particular importance in the event that the user has a physical disability, such as strained back or neck, vertibrae or muscles or has difficulty sleeping on a conventional mattress, or is a bedridden geriatric patient, or is one undergoing prolonged therapeutic treatment, or, is one suffering from post-operative surgical trauma.

In the alternative, the support is one that provides a readily transportable cushion to be used by a sunbather, or as a cushion for a person reading while in bed or relaxing on the floor, or as a cushion for use by a person undergoing massage, such persons being presumed to be in normal health and vigor.

SUMMARY OF THE INVENTION

According to the present invention, the support for a human torso is comprised of first and second elongate cylindrical members arranged in spaced relationship, and which are interconnected one with the other by a central member which extends throughout a major portion of the axial length of the first and second cylindrical members. In this manner, a composite support is provided simulating the shape of a catamaran.

The first and second cylindrical members are of considerably greater cross-sectional area when viewed in transverse cross-section than is the cross-section of the interconnecting member when viewed in transverse cross-section, thus to provide an open tunnel that extends beneath the interconnecting member and between the first and second cylinder members, and a trough-shaped depression extending above the interconnecting member and intermediate the first and second cylindrical members.

The interconnecting member also is an inflatable member that extends generally in a plane that includes the longitudinal axis of the first and second cylindrical members, the interconnecting member thus providing an inflated transition between the first and second cylindrical members that has a resistance to hinging, and which at all time acts to bias the interconnecting member towards planar relationship with the longitudinal axis of the first and second cylindrical members.

Preferably, the first and second elongate cylindrical members are arranged with the longitudinal axis of the respective cylindrical members arranged at an acute angle relative to each other and in convergent relationship.

DESCRIPTION OF THE DRAWINGS

The invention will now be described with reference to the accompanying drawings, in which.

DESCRIPTION OF THE PREFERRED EMBODIMENT

Figure 1:
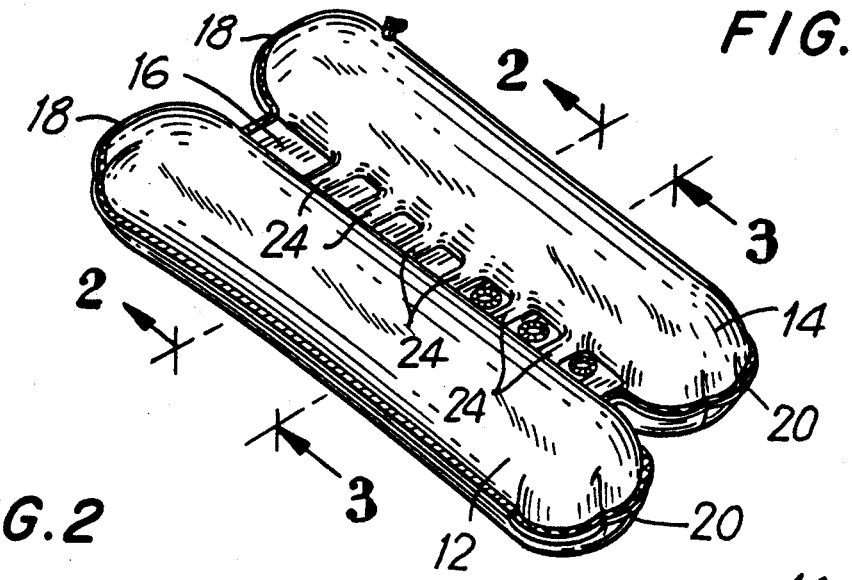
FIG. 1 is a perspective view of the support of the invention when in an inflated condition.

Referring firstly to FIG. 1, the support of the invention is comprised of two main inflatable sections 12 and 14 that are interconnected by a central inflatable section 16, thus to provide a support having the general shape of a catamaran.

The main sections 12 and 14 each are substantially cylindrical in transverse cross-section, and, each tapers from a larger diameter end thereof 18 to an opposite smaller diameter end thereof 20. As is more clearly shown in FIG. 4, the longitudinal axis 22 of the respective main sections 12 and 14 are arranged in convergent relationship, and converge from the larger end 18 to the smaller opposite end 20.

The main and central sections 12, 14, and 16 are formed integrally with each other from sheet plastic material of sufficient strength and thickness to resist balooning of the plastic material when under the pressure of inflation of the support, and under the additional internal pressure caused by the weight of the user when recumbent o the support. Suitable materials are vinyl sheeting, crystalline oriented plastics sheeting, and structurally reinforced plastics sheeting that have been laminated to or formed in situ about woven fabric or mesh, such materials being well-known in the art. Conventional heat-sealing or ultra-sonic sealing techniques can be employed in the fabrication of the support from the sheet plastics material.

The central section 16 is formed to provide spaced inflatable portions 24 that provide for the passage of pressurized air from the main inflatable section 14 to the other main inflatable section 12, the inflatable section 14 being provided with an inflation nipple 15 of conventional form. In the inflated condition of the support, the portions 24 provide tubular struts that act to maintain the main inflatable sections 12 and 14 in their correct orientation, both prior to and during use of the support.

Intermediate the tubular portions 24 and integral with the main supports 12 and 24 are webs 26, the webs 26 acting to prevent displacement of the main sections 12 and 14 laterally away from one another. Conveniently, selected ones of the webs 26 can be provided with ventilation holes 28 in order to provide for air circulation through the body of the otherwise impervious support.

Figure 4:
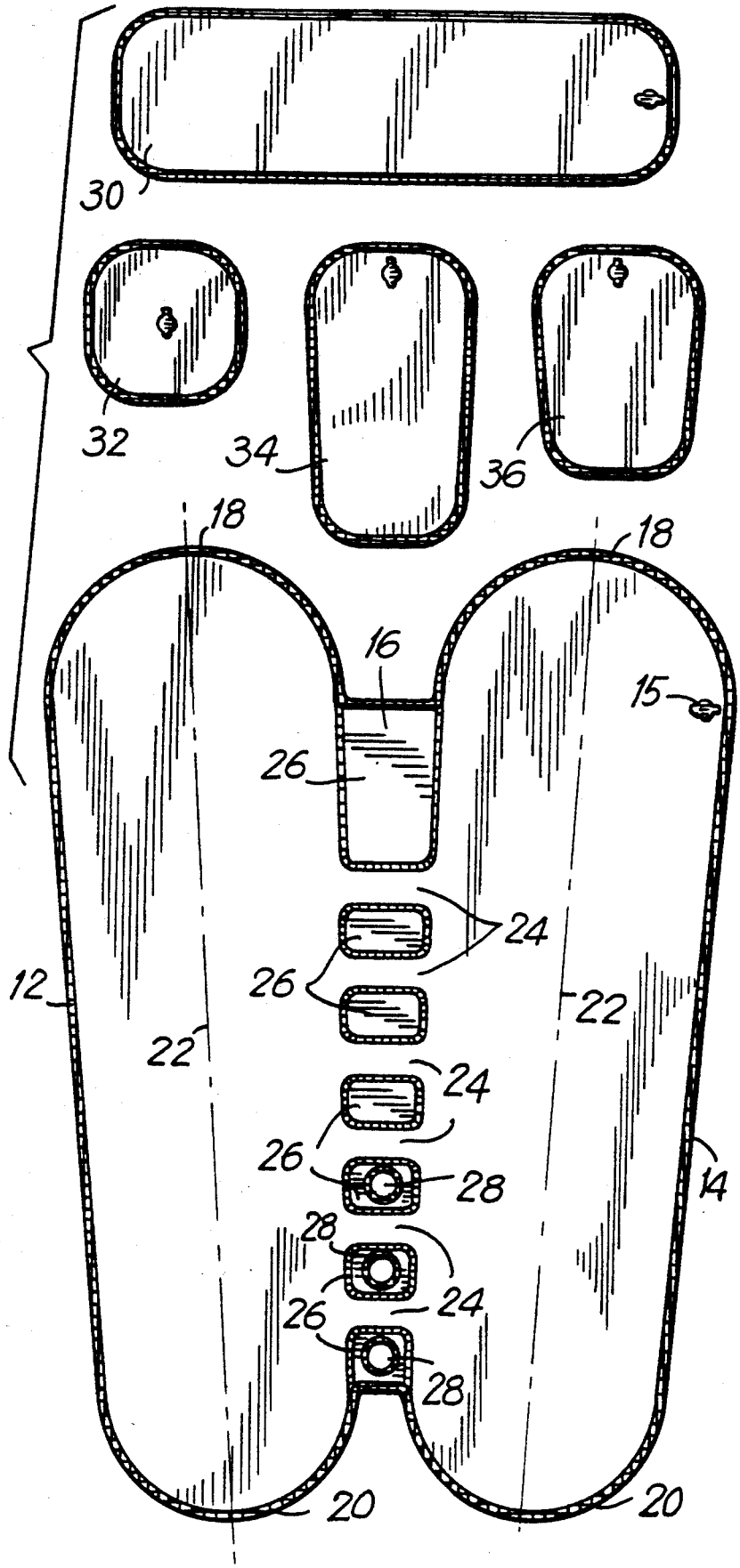
FIG. 4 is a plan view of the support, showing, in association therewith, additional inflatable members to be employed in conjunction with the support, those members being shown in a planar condition prior to inflation.
Figure 5:
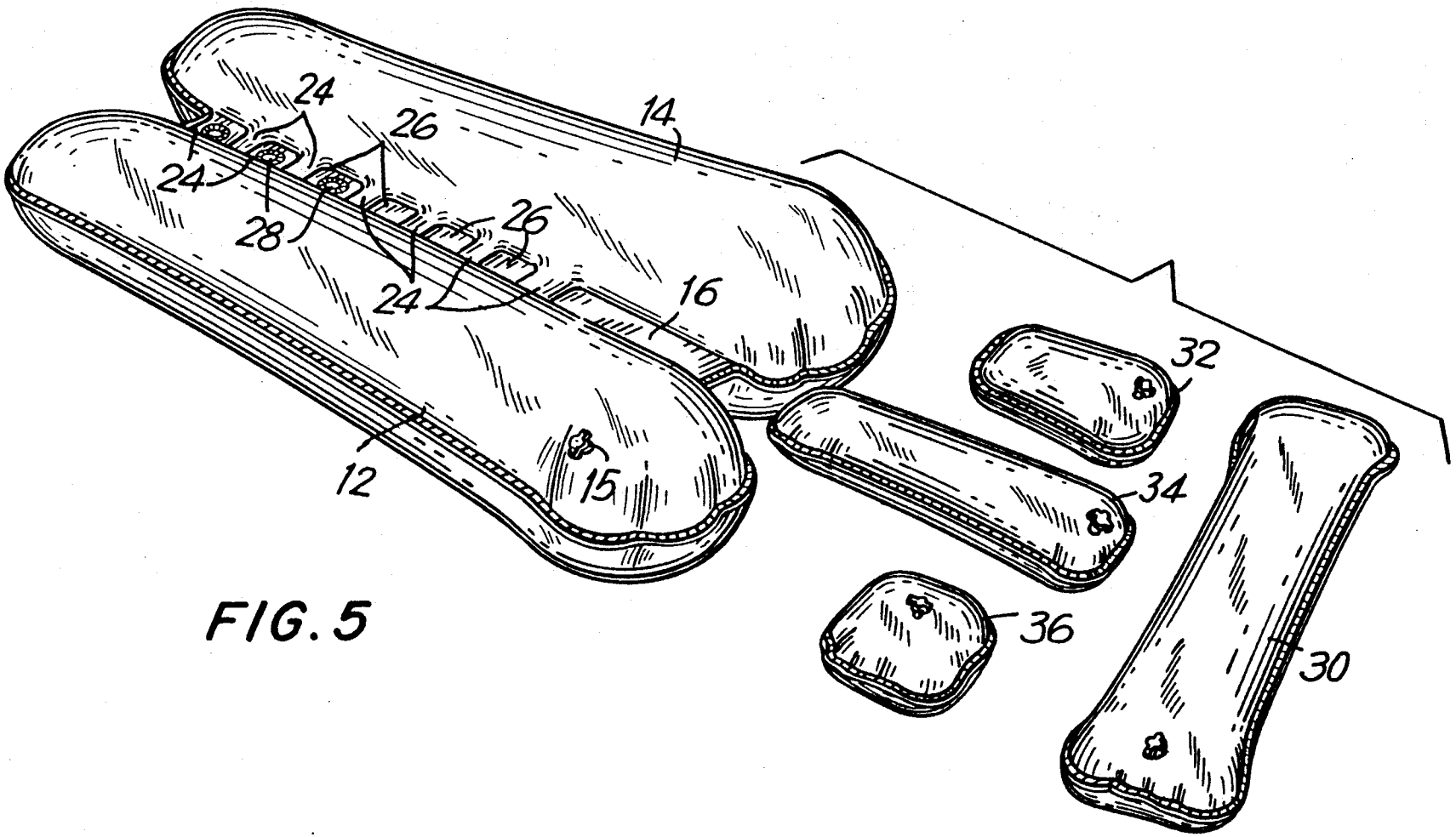
FIG. 5 is a perspective view corresponding with FIG. 4, and showing the support and the additional support members in an inflated condition.

The structure so far described comprises the basic main support for a human torso. In order to modify the support characteristics of the main support, additional inflatable members are provided, as is shown in FIGS. 4 and 5, those additional inflatable members being of various selected forms, and being appropriately sized for them to be pushed into the tunnel indicated by the arrow T existing beneath the central section 16, thus, to provide additional support in that location, the support being adjustable in the longitudinal direction of the main support in order for it to be positioned at any desired specific position beneath the torso of the user. In FIGS. 4 and 5, a large section 30 of generally rectangular configuration is provided, Which, can either be positioned within the tunnel beneath the central section 16, and, extend substantially continuously throughout the length of the central section 16, the member 30 also being useable in the alternative as a foot or knee rest for the user.

Additional members 32, 34 and 36, each of different axial lengths, in the alternative can be inserted into the tunnel beneath the central section 16, and, moved longitudinally within the tunnel to a selected position. When moved to that selected position, the member that is being employed, upon loading of the support by the torso of the user, will be very securely held in position within the tunnel in such a manner that it is not likely to be displaced longitudinally within the tunnel by movements of the user such as the user's sitting up or rolling over on the support.

Figure 2:
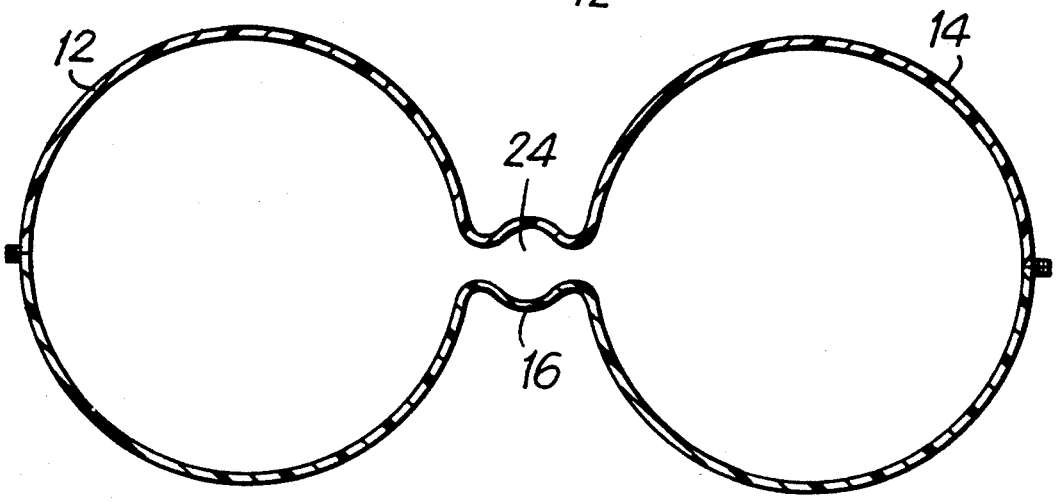
FIG. 2 is a transverse cross-section taken on the lines II—II of FIG. 1.
Figure 3:
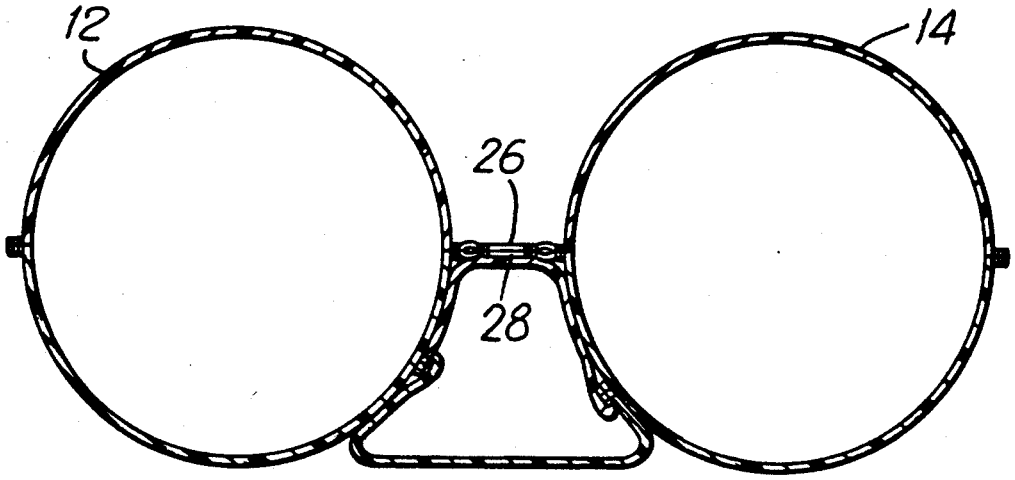
FIG. 3 is a transverse cross-section taken on the lines III—III of FIG. 1.

The user will, of course, be supported predominantly by the main sections 12 and 14, which will act to stabilize the torso of the user on the support against laterally rolling off the support. While the main sections have been shown in FIGS. 2 and 3 as being essentially circular in transverse cross-section, it will, of course, be appreciated that the main sections 12 and 14 respectively can be of elliptical cross-section, the major axis of the respective ellipses extending in horizontal planes and extending through the central portion 16.

While the support of the invention has been described in its use as a support that is inflated by air under pressure, it will be appreciated that the support could in the alternative be inflated with water in order to provide a water mattress, the filling of the support with water being effected through the nipple 15 or an equivalent such filling member.

Optionally, the support can be finish coated exteriorly of the support by flocking sprayed under an electrostatic charge, as is well known in the art to provide a velvet or textile-like finish. Alternatively, the support can be inserted into an appropriately tailored bag, provided with zip fasteners or other closure members, the bag itself being formed from sheeting or toweling that readily can be laundered.

While in FIGS. 1, 4 and 5, the nipple 15 has been shown positioned on a top surface of the support, it will be understood that in actual use of the support, the support would be inverted for the nipple 15 to be positioned below the support and out of contact with the user.

What is claimed is:

1. A support for a human torso, comprised by:

inflatable first and second elongate cylindrical members (12,14) arranged in spaced relationship, and, an inflatable central member (16) interconnecting said first and second cylindrical members (12,14) throughout a major portion of the axial length (22) of said first and second cylindrical members, whereby to provide a composite support simulating the shape of a catamaran;

said first and second cylindrical members (12,14) being of considerably greater cross-sectional area when viewed in transverse cross-section than is the cross-section of said interconnecting member (16) when viewed in transverse cross-section (FIG. 2), said interconnecting member (16) extending in a plane that includes the longitudinal axis of said first and second cylindrical members (12,14), whereby said interconnecting member, in conjunction with said first and second cylindrical members, defines a tunnel (T) extending beneath said support when said first and second cylindrical members (12,14) are placed on a support surface, thus permitting the selective positioning of additional support members (32,36) within said tunnel and beneath said support, said support further comprising at least one additional inflatable member(32–36) selectively positionable within said tunnel (T) and operative to provide localized additional support for said human torso when supported on said support.

2. The support of claim 1, in which the longitudinal axis of said respective first and second elongate cylindrical members respectively converge towards each other at an acute angle.

3. The support of claim 1, in which said first and second members (12,14) are interconnected.

4. The support of claim 3, in which said support (12,14,16) is formed from sheet plastics material.

5. The support of claim 1, in combination with a secondary support (30) providing a foot-rest for a patient.

6. A support for a human torso, comprised by:

inflatable first and second elongate cylindrical members (12,14) arranged in spaced relationship, and, an inflatable central member (16) interconnecting said first and second cylindrical members (12,13) throughout a major portion of the axial length (22) of said first and second cylindrical members, whereby to provide a composite support simulating the shape of a catamaran;

said first and second cylindrical members (12,14) being of considerably greater cross-sectional area when viewed in transverse cross-section than is the cross-section of said interconnecting member (16) when viewed in transverse cross-section (FIG. 2), said interconnecting member (16) extending in a plane that includes the longitudinal axis of said first and second cylindrical members (12,14), whereby said interconnecting member, in conjunction with said first and second cylindrical members, defines a tunnel (T) extending beneath said support when said first and second cylindrical members (12,14) are placed on a support surface, thus permitting the selective positioning of additional support members (32,36) within said tunnel and beneath said support;

said respective first and second elongate cylindrical members respectively converging towards each at an acute angle;

further including at least one additional inflatable member selectively positionable within said tunnel bracket and operative to provide localized additional support for said human torso when said supported on said support.

7. The support of claim 6, in which said support is formed from sheet plastics material.

8. The support of claim 6, in combination with a secondary support member providing a foot-rest for a patient.

* * * * *